US007266930B1

(12) United States Patent
Fisher

(10) Patent No.: US 7,266,930 B1
(45) **Date of Patent: *Sep. 11, 2007**

(54) CONSTRUCTION BLOCK

(75) Inventor: Myles A. Fisher, Pensacola, FL (US)

(73) Assignee: US Block Windows, Inc., Pensacola, FL (US)

( * ) Notice: Subject to any disclaimer, the term of this patent is extended or adjusted under 35 U.S.C. 154(b) by 116 days.

This patent is subject to a terminal disclaimer.

(21) Appl. No.: 10/701,131

(22) Filed: Nov. 3, 2003

Related U.S. Application Data

(63) Continuation of application No. 10/002,190, filed on Nov. 28, 2001, now Pat. No. 6,802,162.

(51) Int. Cl.
*E04C 1/42* (2006.01)

(52) U.S. Cl. ..... 52/306; 52/172; 52/786.11

(58) Field of Classification Search ..... 65/58; 52/306–308, 309.1, 309.15, 171.3, 172, 786.1, 52/786.11
See application file for complete search history.

(56) References Cited

U.S. PATENT DOCUMENTS

| | | | | | |
|---|---|---|---|---|---|
| 1,991,469 | A * | 2/1935 | Games | 52/306 |
| 2,118,643 | A * | 5/1938 | Fox | 52/307 |
| 2,158,089 | A * | 5/1939 | Slick | 52/306 |
| 2,167,764 | A * | 8/1939 | Lytle | 52/307 |
| 2,221,649 | A * | 11/1940 | Willard | 52/307 |
| 2,532,478 | A * | 12/1950 | Bridges | 52/306 |
| 5,006,967 | A * | 4/1991 | Diamond | 362/147 |
| 5,038,542 | A * | 8/1991 | Kline | 52/306 |
| 5,160,566 | A * | 11/1992 | Ashby et al. | 156/252 |
| 5,588,271 | A * | 12/1996 | Pitchford | 52/306 |
| 5,595,032 | A * | 1/1997 | Richards et al. | 52/306 |
| 5,595,033 | A * | 1/1997 | Frey | 52/306 |
| 5,904,019 | A * | 5/1999 | Kooij et al. | 52/306 |
| 6,039,390 | A | 3/2000 | Agrawal et al. | |
| 6,260,317 | B1 * | 7/2001 | Fisher | 52/306 |
| 6,393,786 | B1 * | 5/2002 | Hudson et al. | 52/306 |
| 6,553,733 | B1 * | 4/2003 | Hock et al. | 52/306 |
| 6,802,162 | B1 * | 10/2004 | Fisher | 52/306 |
| 2004/0226239 | A1 * | 11/2004 | Regina et al. | 52/306 |

* cited by examiner

*Primary Examiner*—Robert Canfield
(74) *Attorney, Agent, or Firm*—Peter Loffler

(57) ABSTRACT

A construction block which has improved thermal insulation qualities, has improved sound transmission migration reduction properties, and which reduces or outright eliminates the effects of a seam failure. The construction block is comprised of a pair of generally parallel faces joined by a plurality of sides. At least one baffle is disposed within the interior chamber and is located along the weld seam that joins the two body member halves of the construction block. A desiccant or insulation gas, or both can be disposed within the interior chamber of the block.

129 Claims, 3 Drawing Sheets

CONSTRUCTION BLOCK

This application is a continuation of patent application Ser. No. 10/002,190 filed on Nov. 28, 2001, now U.S. Pat. No. 6,802,162.

BACKGROUND OF THE INVENTION

1. Field of the Invention

The present invention relates to a construction block having good insulation and fault-tolerant properties.

2. Background of the Prior Art

Construction blocks are typically but not necessarily rectangular members having a pair of faces joined by four sides. These blocks, which are use to build partition structures, are usually transparent or translucent and may have a texture pattern on the faces. The outer surface of the blocks may be smooth or may have an appropriate mechanism for joining the block to other blocks. U.S. Pat. No. 5,595,033 to Frey, 5,588,271 to Pitchford and my U.S. Pat. No. 5,778,620 are examples of such mechanisms. The blocks, which are made from glass, plastic or a similar material, are typically formed as two generally identical halves welded or adhered together forming a seam.

These construction blocks, which enjoy wide popularity in the construction industry, have several areas that can benefit from improvement. Although, modern construction blocks have a relatively high level of thermal insulation and sound insulation capability, these levels can always withstand being raised. Another problem with present construction blocks is found in seam failure. A small hole along the seam not only reduces the insulation properties of that block but also serves as in introduction point for moisture to enter the interior chamber of the block. The moisture within the block condenses and becomes unsightly. The moisture introduction is exacerbated by the bellowing effect created by the block due to the difference in temperature between the block face on the interior of the building and the temperature of the block face on the exterior of the building which is exacerbated by the cycling of the construction block due to the heating of the block due to the relative heat of the day and the cooling of the block due to the relative coolness of the night.

Therefore, there is a need in the art for a construction block that addresses the aforementioned shortcomings of the present day blocks. Such a construction block must have improved thermal and sound insulation properties and must limit the adverse effects of a failed seam.

SUMMARY OF THE INVENTION

The construction block and method of the present invention addresses the aforementioned needs in the art. The construction block increases the thermal efficiency and sound insulation of the block. The construction block also attacks the moisture problem experienced from a failed seam by outright eliminating the condensation within the interior chamber of the block or by isolating the condensation from the sight of a user. The bellowing effect—which tends to pull air from the exterior of the block into the interior chamber of the block through the pinhole in the welded block seam is reduced. A method of increasing the thermal efficiency or eliminating the condensation is also disclosed.

The construction block of the present invention is comprised of a pair of body members each having a face joined by a plurality of side edges with inwardly directed side portions, edge portions of the side portions in abutting relationship with the edge portions of the other body member and joined by a welded or adhesive seam defining an interior chamber. A baffle having an outer periphery is located within the interior space and disposed generally parallel with the pair of faces and along the seam, to form two separate areas within the interior chamber whereby a bellow effect of the faces is reduced. The baffle has an upwardly turned up edge and the one or both of the body members has a recessed section for receiving the turned up edge Means for joining the construction block with other construction blocks, may but need not be provided.

An appropriate desiccant, an insulation gas, or both are disposed within the interior chamber of the construction block. The desiccant lies at the bottom of the construction block out of sight of a user. At least one opening can be provided on the block for introduction of the desiccant or insulation gas, the opening being airtight sealed after introduction. Alternately, at least one weakened area, which may or not be perforated, may be provided on the construction block. The weakened area can be punched by a screwdriver or similar instrument for creating the opening. A locator mark can be provided on the block in the area defined by the weakened area for easy and consistent location of the weakened area. Alternately, the locator mark can be provided on the block (without the block having a weakened area) so that a person can drill an opening at the locator mark. The opening, weakened area, or locator mark can be located on at least one of the faces, on at least one of the sides or both. By providing these members on the side of the block, the sealed opening will not be visible to a user.

The baffle or a face of the block may have an appropriate coating, such as an optical or heat reflective coating, thereon.

The baffle serves several important roles. The baffle adds additional thermal insulation capacity and sound insulation capacity to the construction block. The baffle reduces the bellow effects created by the inner positioned face and the outer positioned face. The baffle separates the interior chamber into two or more sub-chambers. For example, by placing two baffles into the interior chamber, one baffle on one side of the seam and the other baffle on the other side of the seam, the interior chamber is separated into three sub-chambers. Therefore, any moisture and the resulting condensation that is introduced into the construction block through a failure in the seam is isolated within the middle sub-chamber out of sight of a user. Lastly, the baffles may be used to add to the overall aesthetic qualities of the block by coming indifferent colors, patterns including light diffusing patterns, smoked appearance, etc.

BRIEF DESCRIPTION OF THE DRAWINGS

Similar reference numerals refer to similar parts throughout the several views of the drawings.

DESCRIPTION OF THE PREFERRED EMBODIMENT

Figure 1:
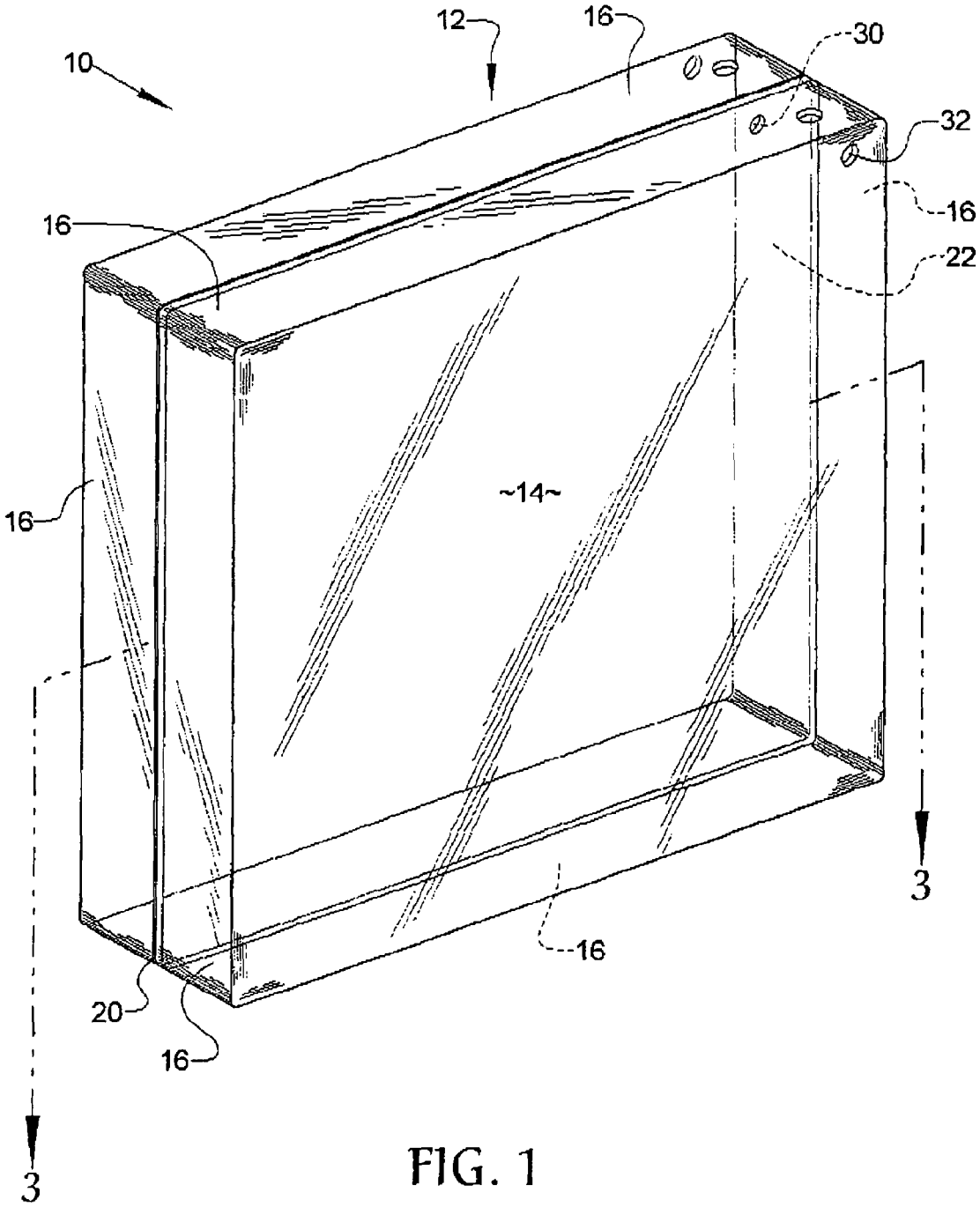
FIG. 1 is a perspective view of one of the construction block of the present invention.
Figure 2:
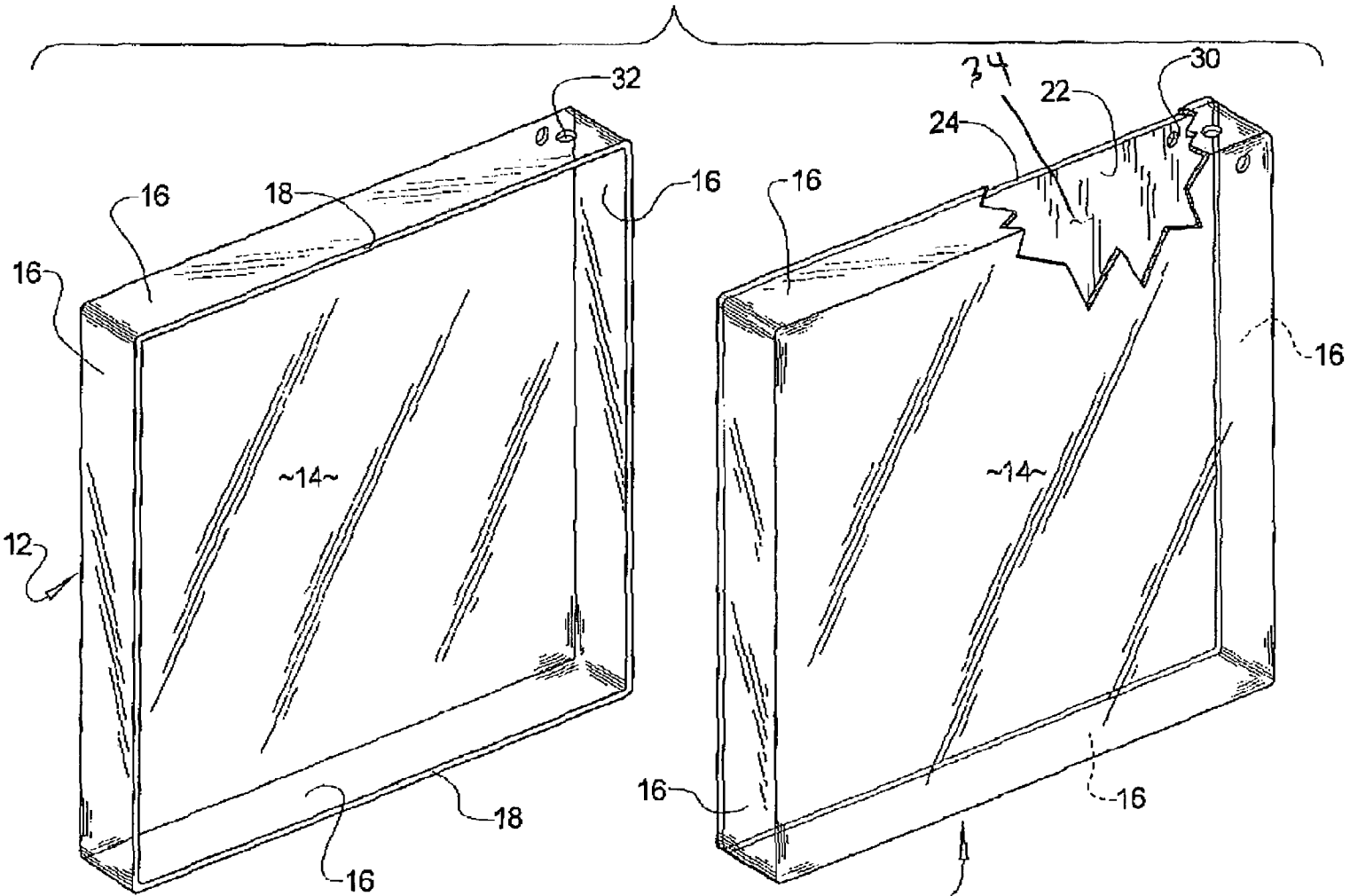
FIG. 2 is a perspective view of the two body member used to form the construction block, with the body members separated from one another and one of the body members partially sectioned.
Figure 3:
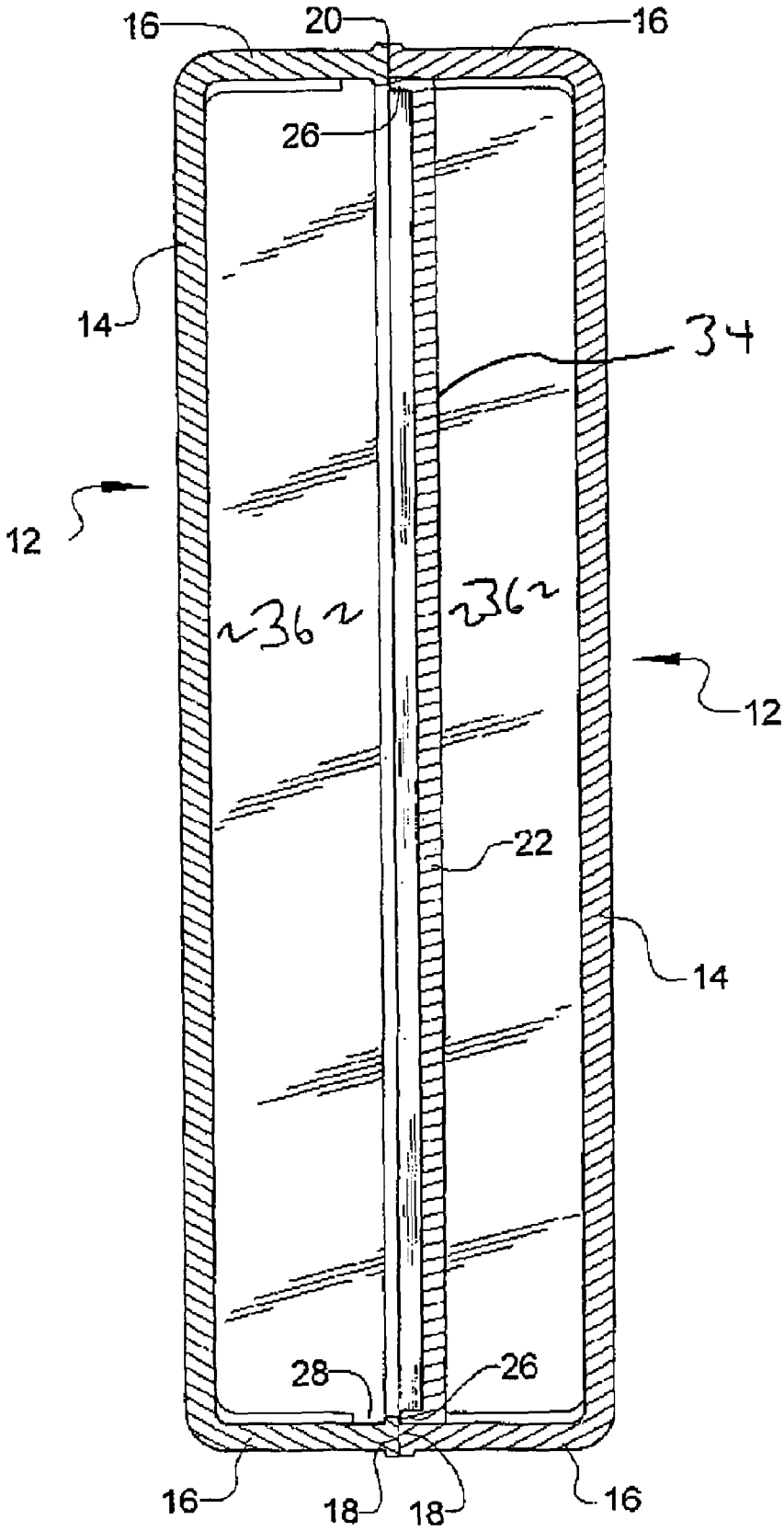
FIG. 3 is a sectioned view of the construction block taken along line 3-3 in FIG. 1.

Referring now to the drawings, it is seen that the construction block and method of the present invention, generally denoted by reference numeral 10, is comprised of a generally rectangular body that is formed from two similar body members 12 each having a face portion 14 with inwardly directed side portions 16, edge portions 18 of the side portions 16 in abutting relationship with each other and joined by a welded or adhesive seam 20 to define an interior chamber. The joiner of the two body members 12 can be accomplished in appropriate fashion such as by heat welding the two halves along the seam 20, using an appropriate adhesive, etc. It is expressly understood that the construction block 10 can be constructed in a shape other than rectangular, and having other than four sides, in keeping within the scope and spirit of the present invention. The outer surface of the construction block 10 can be generally smooth, as illustrated, or can have any appropriate structure for joining the construction block 10 to other construction blocks 10, as is well known in the art. The faces 14 of the construction block 10 can be transparent, translucent, or opaque. The face portion 14 may also have an appropriate textured surface, such as a wave pattern, column pattern, etc., if desired. The body members 12 are formed from an appropriate resin material, such as acrylic, polycarbonate, copolymers, etc.

A baffle 22 having an outer periphery 24 is located within the interior chamber of the joined body members 12 and is disposed generally parallel with the pair of faces 14 and along the seam 20, to form two separate areas within the interior chamber whereby a bellow effect of the faces 14 is reduced by limiting the amount of air that passes between the two separate areas created by the baffle 22 within the interior chamber. The outer periphery 24 of the baffle 22 is joined to one or more of the of the side faces 16 of either or both of the body members 12 that make up the construction block 10. The baffle 22 may have an upwardly turned up edge 26 and one or both of the body members 12 has a recessed section 28 for receiving the turned up edge 26 of the baffle 22. The baffle 22 may have an opening 30 located thereon in order to allow any insulation gas that is introduced into one of the separate areas to pass into the other areas within the interior chamber.

In order to create the construction block 10 of the present invention, the baffle 22 is positioned within the interior chamber of the two body members 12. If one or both of the body members 12 has a recessed section 28, the baffle 22 is seated therein. The two body members 12 are brought together such that the respective edge portions 18 abut one another along a seam 20. The two body members 12 are either joined to one another, either by heat welding or by adhesion or other appropriate joinder technique.

Each baffle 22, or a face of the block, preferably an interior face, can be provided with an appropriate coating 34 such as an optical or a heat reflective coating on one or both surfaces. This coating 34 can be used to control the effects of the sun, such as an ultraviolet light barrier coating or can be a visual coating, such as a tint, a color, or a reflective surface in order to change the overall appearance and/or thermal efficiency created by the construction block 10. By placing the coating 34 on the baffle 22 or an interior face of the block 10, the coating is safely sealed within interior of the construction block 10 so that it cannot be scratched or otherwise tampered with.

Disposed within the interior chamber of the construction block 10 can be an appropriate desiccant 36 for absorbing any moisture within the interior chamber. As the desiccant 36 will fall to the bottom of the interior chamber, it will not be readily visible even in a construction block 10 having transparent faces 14. Alternately, or in addition to the desiccant 36, an insulation gas may be disposed within the interior chamber. The insulation gas is chosen from the group consisting of argon, krypton, xenon, or combinations thereof or any other insulating gas or combination thereof.

In order to introduce the desiccant 36 or insulation gas into the interior chamber, the construction block 10 may be formed with at least one opening 32 located thereon. The opening 32 can be located on at least one of the faces 14, on at least one of the sides 16, or both. After the desiccant 36 or insulation gas is introduced into the interior chamber, each opening 32 may be sealed in any appropriate fashion.

Alternately, at least one weakened portion can be provided on at least one of the faces 14, on at least one of the side edges 16, or both. The weakened portion may be punched out with a screwdriver, drill or other similar tool and the desiccant or insulation gas introduced through the opening thus created.

Again, after the desiccant 36 or insulation gas is introduced into the interior chamber, each opening may be sealed in any appropriate fashion. A locator mark (not illustrated) can be provided on the area encompassed by the weakened portion for easy location of the weakened area. Alternately, the locator mark may be provided on any appropriate portion of the construction block 10 so that the area identified by the locator mark may be drilled to provide a consistent location for the opening for introduction of the desiccant 36 or insulation gas. Again, after the desiccant 36 or insulation gas is introduced into the interior chamber, each opening may be sealed in any appropriate fashion.

While the invention has been particularly shown and described with reference to an embodiment thereof, it will be appreciated by those skilled in the art that various changes in form and detail may be made without departing from the spirit and scope of the invention.

I claim:

1. A construction block comprising:

a body formed from a resinous material, the body formed by a pair of face portions with inwardly directed side portions, edge portions of the side portions in abutting relationship and joined by a welded or adhesive seam defining an interior chamber; and a baffle having an outer periphery, the baffle completely located within the interior chamber and disposed generally parallel with the pair of face portions and parallel with and completely located offset to one side of a plane passing through the seam such that the outer periphery is attached to an inner surface of the side portions, to form two separate areas within the interior chamber such that air flow between the two separate areas is minimized and whereby a bellow effect of the faces is reduced.

2. The construction block as in claim 1 wherein the outer periphery of the baffle has a upwardly turned up edge.

3. The construction block as in claim 2 wherein the body has a recessed section for receiving the turned up edge.

4. The construction block as in claim 1 further comprising a desiccant disposed within the interior chamber.

5. The construction block as in claim 1 further comprising an insulation gas disposed within the interior chamber.

6. The construction block as in claim 5 wherein the insulation gas is selected from the group consisting of argon, krypton, xenon or combinations thereof.

7. The construction block as in claim 1 further comprising at least one opening located on the construction block.

8. The construction block as in claim 1 further comprising an optical coating or heat reflective coating disposed on the baffle or on one of the face portions of the block.

9. A construction block comprising:

a body formed from a resinous material the body formed by a pair of face portions with inwardly directed side portions, edge portions of the side portions in abutting relationship and joined by a welded or adhesive seam defining an interior chamber; and a baffle having an outer periphery and an opening located thereon, the baffle completely located within the interior space and disposed generally parallel with the pair of face portions and parallel with and completely located offset to one side of a plane passing through the seam such that the outer periphery is attached to an inner surface of the side portions, to from two separate areas within the interior chamber such that air flow between the two separate areas passes through the opening located on the baffle and whereby a bellow effect of the faces is reduced.

10. The construction block as in claim 9 wherein the outer periphery of the baffle has a upwardly turned up edge.

11. The construction block as in claim 10 wherein the body has a recessed section for receiving the turned up edge.

12. The construction block as in claim 9 further comprising a desiccant disposed within the interior chamber.

13. The construction block as in claim 9 further comprising an insulation gas disposed within the interior chamber.

14. The construction block as in claim 13 wherein the insulation gas is selected from the group consisting of argon, krypton, xenon or combinations thereof.

15. The construction block as in claim 9 further comprising at least one opening located on the construction block.

16. The construction block as in claim 9 further comprising an optical coating or heat reflective coating disposed on the baffle or on one of the face portions of the block.

17. A construction block comprising:

a body formed from a resinous material, the body formed by a pair of face portions with inwardly directed side portions, edge portions of the side portions in abutting relationship and joined by a welded or adhesive seam defining an interior chamber; and a baffle having an outer periphery, the baffle completely located within the interior chamber and joined to each of the side portions associated with at least one of the face portions, the baffle disposed generally parallel with the pair of face portions and parallel with and completely located offset to one side of a plane passing through the seam such that the outer periphery is attached to an inner surface of the side portions, to form two separate areas within the interior chamber such that air flow between the two separate areas is minimized and whereby a bellow effect of the faces is reduced.

18. The construction block as in claim 17 wherein the outer periphery of the baffle has a upwardly turned up edge.

19. The construction block as in claim 18 wherein the body has a recessed section for receiving the turned up edge.

20. The construction block as in claim 17 further comprising a desiccant disposed within the interior chamber.

21. The construction block as in claim 17 further comprising an insulation gas disposed within the interior chamber.

22. The construction block as in claim 21 wherein the insulation gas is selected from the group consisting of argon, krypton, xenon or combinations thereof.

23. The construction block as in claim 17 further comprising at least one opening located on the construction block.

24. The construction block as in claim 17 further comprising an optical coating or heat reflective coating disposed on the baffle or on one of the face portions of the block.

25. The construction block as in claim 17 further comprising at least one opening located on the baffle.

26. A construction block comprising:

a body formed from a resinous material, the body formed by a pair of face portions with inwardly directed side portions, edge portions of the side portions in abutting relationship and joined by a welded or adhesive seam defining an interior chamber; and a baffle having an outer periphery, the baffle completely located within the interior chamber and joined to the body along the seam such that the outer periphery is attached to an inner surface of the side portions, the baffle disposed generally parallel with the pair of face portions and parallel with and completely located offset to one side of a plane passing through the seam, to form two separate areas within the interior chamber such that air flow between the two separate areas is minimized and whereby a bellow effect of the faces is reduced.

27. The construction block as in claim 26 wherein the outer periphery of the baffle has a upwardly turned up edge.

28. The construction block as in claim 27 wherein the body has a recessed section for receiving the turned up edge.

29. The construction block as in claim 26 further comprising a desiccant disposed within the interior chamber.

30. The construction block as in claim 26 further comprising an insulation gas disposed with the interior chamber.

31. The construction block as in claim 30 wherein the insulation gas is selected from the group consisting of argon, krypton, xenon or combinations thereof.

32. The construction block as in claim 26 further comprising at least one opening located on the construction block.

33. The construction block as in claim 26 further comprising an optical coating or heat reflective coating disposed on the baffle or on one of the face portions of the block.

34. The construction block as in claim 26 further comprising at least one opening located on the baffle.

35. A construction block comprising:

a body formed from a resinous material, the body formed by a pair of face portions with inwardly directed flat side portions, edge portions of the side portions in abutting relationship and joined by a welded or adhesive seam defining an interior chamber; and a baffle having an outer periphery, the baffle completely located within the interior chamber and disposed generally parallel with the pair of face portions and parallel with and completely located offset of one side of a plane passing through the seam such that the outer periphery is attached to an inner surface of the side portions, to form two separate areas within the interior chamber such that air flow between the two separate areas is minimized and whereby a bellow effect of the faces is reduced.

36. The construction block as in claim 35 wherein the outer periphery of the baffle has a upwardly turned up edge.

37. The construction block as in claim 36 wherein the body has a recessed section for receiving the turned up edge.

38. The construction block as in claim 35 further comprising a desiccant disposed within the interior chamber.

39. The construction block as in claim 35 further comprising an insulation gas disposed within the interior chamber.

40. The construction block as in claim 39 wherein the insulation gas is selected from the group consisting of argon, krypton, xenon or combinations thereof.

41. The construction block as in claim 35 further comprising at least one opening located on the construction block.

42. The construction block as in claim 35 further comprising an optical coating or heat reflective coating disposed on the baffle or on one of the face portions of the block.

43. The construction block as in claim 35 further comprising at least one opening located on the baffle.

44. A construction block comprising:

a body formed from a resinous material, the body formed by a pair of face portions with inwardly directed side portions, edge portions of the side portions in abutting relationship and joined by a welded or adhesive seam defining an interior chamber; and a baffle having an outer periphery, the baffle completely located within the interior chamber and disposed generally parallel with the pair of face portions completely located offset of one side of the seam such that the outer periphery is attached to an inner surface of the side portions, to form two separate areas within the interior chamber such that air flow between the two separate areas is minimized and whereby a bellow effect of the faces is reduced.

45. The construction block as in claim 44 wherein the outer periphery of the baffle has a upwardly turned up edge.

46. The construction block as in claim 45 wherein the body has a recessed section for receiving the turned up edge.

47. The construction block as in claim 44 further comprising a desiccant disposed within the interior chamber.

48. The construction block as in claim 44 further comprising an insulation gas disposed within the interior chamber.

49. The construction block as in claim 48 wherein the insulation gas is selected from the group consisting of argon, krypton, xenon or combinations thereof.

50. The construction block as in claim 44 further comprising at least one opening located on the construction block.

51. The construction block as in claim 44 further comprising an optical coating or heat reflective coating disposed on the baffle or on one of the face portions of the block.

52. A construction block comprising:

a body formed from a resinous material, the body formed by a pair of face portions with inwardly directed side portions, edge portions of the side portions in abutting relationship and joined by a welded or adhesive seam defining an interior chamber; and a baffle having an outer periphery and an opening located thereon, the baffle completely located within the interior space and disposed generally parallel with the pair of face portions completely located offset to one side of the seam such that the outer periphery is attached to an inner surface of the side portions, to form two separate areas within the interior chamber such that air flow between the two separate areas passes through the opening located on the baffle and whereby a bellow effect of the faces is reduced.

53. The construction block as in claim 52 wherein the outer periphery of the baffle has a upwardly turned up edge.

54. The construction block as in claim 53 wherein the body has a recessed section for receiving the turned up edge.

55. The construction block as in claim 52 further comprising a desiccant disposed within the interior chamber.

56. The construction block as in claim 52 further comprising an insulation gas disposed within the interior chamber.

57. The construction block as in claim 56 wherein the insulation gas is selected from the group consisting of argon, krypton, xenon or combinations thereof.

58. The construction block as in claim 52 further comprising at least one opening located on the construction block.

59. The construction block as in claim 52 further comprising an optical coating or heat reflective coating disposed on the baffle or on one of the face portions of the block.

60. A construction block comprising:

a body formed from a resinous material, the body formed by a pair of face portions with inwardly directed side portions, edge portions of the side portions in abutting relationship and joined by a welded or adhesive seam defining an interior chamber; and a baffle having an outer periphery, the baffle completely located within the interior chamber and joined to each of the side portions associated with at least one of the face portions, the baffle disposed generally parallel within the pair of face portions completely located offset to one side of the seam such that the outer periphery is attached to an inner surface of the side portions, to form two separate areas within the interior chamber such that air flow between the two separate areas is minimized and whereby a bellow effect of the faces is reduced.

61. The construction block as in claim 60 wherein the outer periphery of the baffle has a upwardly turned up edge.

62. The construction block as in claim 61 wherein the body has a recessed section for receiving the turned up edge.

63. The construction block as in claim 60 further comprising a desiccant disposed within the interior chamber.

64. The construction block as in claim 60 further comprising an insulation gas disposed within the interior chamber.

65. The construction block as in claim 64 wherein the insulation gas is selected from the group consisting of argon, krypton, xenon or combinations thereof.

66. The construction block as in claim 60 further comprising at least one opening located on the construction block.

67. The construction block as in claim 60 further comprising an optical coating or heat reflective coating disposed on the baffle or on one of the face portions of the block.

68. The construction block as in claim 60 further comprising at least one opening located on the baffle.

69. A construction block comprising:

a body formed from a resinous material, the body formed by a pair of face portions with inwardly directed side portions, edge portions of the side portions in abutting relationship and joined by a welded or adhesive seam defining an interior chamber; and a baffle having an outer periphery, the baffle completely located within the interior chamber and joined to the body along the seam such that the outer periphery is attached to an inner surface of the side portions completely located offset to one side of the seam, the baffle disposed generally parallel with the pair of face portions, to form two separate areas within the interior chamber such that air flow between the two separate areas is minimized and whereby a bellow effect of the faces is reduced.

70. The construction block as in claim 69 wherein the outer periphery of the baffle has a upwardly turned up edge.

71. The construction block as in claim 70 wherein the body has a recessed section for receiving the turned up edge.

72. The construction block as in claim 69 further comprising a desiccant disposed within the interior chamber.

73. The construction block as in claim 69 further comprising an insulation gas disposed within the interior chamber.

74. The construction block as in claim 73 wherein the insulation gas is selected from the group consisting of argon, krypton, xenon or combinations thereof.

75. The construction block as in claim 69 further comprising at least one opening located on the construction block.

76. The construction block as in claim 69 further comprising an optical coating or heat reflective coating disposed on the baffle or on one of the face portions of the block.

77. The construction block as in claim 69 further comprising at least one opening located on the baffle.

78. A construction block comprising:

a body formed from a resinous material, the body formed by a pair of face portions with inwardly directed flat side portions, edge portions of the side portions in abutting relationship and joined by a welded or adhesive seam defining an interior chamber; and a baffle having an outer periphery, the baffle completely located within the interior chamber and disposed generally parallel with the pair of face portions completely located offset to one side of the seam such that the outer periphery is attached to an inner surface of the side portions, to form two separate areas within the interior chamber such that air flow between the two separate areas is minimized and whereby a bellow effect of the faces is reduced.

79. The construction block as in claim 78 wherein the outer periphery of the baffle has a upwardly turned up edge.

80. The construction block as in claim 79 wherein the body has a recessed section for receiving the turned up edge.

81. The construction block as in claim 78 further comprising a desiccant disposed within the interior chamber.

82. The construction block as in claim 78 further comprising an insulation gas disposed within the interior chamber.

83. The construction block as in claim 82 wherein the insulation gas is selected from the group consisting of argon, krypton, xenon or combinations thereof.

84. The construction block as in claim 78 further comprising at least one opening located on the construction block.

85. The construction block as in claim 78 further comprising an optical coating or heat reflective coating disposed on the baffle or on one of the face portions of the block.

86. The construction block as in claim 78 further comprising at least one opening located on the baffle.

87. A construction block comprising:

a body formed from a resinous material, the body formed by a pair of face portions with inwardly directed side portions, edge portions of the side portions in abutting relationship and joined by a welded or adhesive seam defining an interior chamber; and a baffle having an outer periphery, the baffle completely located within the interior chamber and disposed generally parallel with the pair of face portions such that the outer periphery is attached to an inner surface of only one of the side portions such that opposing attachment points on the inner surface of the one side portion face one another, to form two separate areas within the interior chamber such that air flow between the two separate areas is minimized and whereby a bellow effect of the faces is reduced.

88. The construction block as in claim 87 wherein the outer periphery of the baffle has a upwardly turned up edge.

89. The construction block as in claim 88 wherein the body has a recessed section for receiving the turned up edge.

90. The construction block as in claim 87 further comprising a desiccant disposed within the interior chamber.

91. The construction block as in claim 87 further comprising an insulation gas disposed within the interior chamber.

92. The construction block as in claim 91 wherein the insulation gas is selected from the group consisting of argon, krypton, xenon or combinations thereof.

93. The construction block as in claim 87 further comprising at least one opening located on the construction block.

94. The construction block as in claim 87 further comprising an optical coating or heat reflective coating disposed on the baffle or on one of the face portions of the block.

95. A construction block comprising:

a body formed from a resinous material, the body formed by a pair of face portions with inwardly directed side portions, edge portions of the side portions in abutting relationship and joined by a welded or adhesive seam defining an interior chamber; and a baffle having an outer periphery and an opening located thereon, the baffle completely located within the interior space and disposed generally parallel with the pair of face portions such that the outer periphery is attached to an inner surface of only one of the side portions such that opposing attachment points on the inner surface of the one side portion face one another, to form two separate areas within the interior chamber such that air flow between the two separate areas passes through the opening located on the baffle and whereby a bellow effect of the faces is reduced.

96. The construction block as in claim 95 wherein the outer periphery of the baffle has a upwardly turned up edge.

97. The construction block as in claim 96 wherein the body has a recessed section for receiving the turned up edge.

98. The construction block as in claim 95 further comprising a desiccant disposed within the interior chamber.

99. The construction block as in claim 95 further comprising an insulation gas disposed within the interior chamber.

100. The construction block as in claim 99 wherein the insulation gas is selected from the group consisting of argon, krypton, xenon or combinations thereof.

101. The construction block as in claim 95 her comprising at least one opening located on the construction block.

102. The construction block as in claim 95 further comprising an optical coating or heat reflective coating disposed on the baffle or on one of the face portions of the block.

103. A construction block comprising:

a body formed from a resinous material, the body formed by a pair of face portions with inwardly directed side portions, edge portions of the side portions in abutting relationship and joined by a welded or adhesive seam defining an interior chamber; and a baffle having an outer periphery, the baffle completely located within the interior chamber and joined to each of the side portions associated with at least one of the face portions, the baffle disposed generally parallel with the pair of face portions such that the outer periphery is attached to an inner surface of only one of the side portions such that opposing attachment points on the inner surface of the one side portion face one another, to form two separate areas within the interior chamber such that air flow between the two separate areas is minimized and whereby a bellow effect of the faces is reduced.

104. The construction block as in claim 103 wherein the outer periphery of the baffle has a upwardly turned up edge.

105. The construction block as in claim 104 wherein the body has a recessed section for receiving the turned up edge.

106. The construction block as in claim 103 further comprising a desiccant disposed within the interior chamber.

107. The construction block as in claim 103 further comprising an insulation gas disposed within the interior chamber.

108. The construction block as in claim 107 wherein the insulation gas is selected from the group consisting of argon, krypton, xenon or combinations thereof.

109. The construction block as in claim 103 further comprising at least one opening located on the construction block.

110. The construction block as in claim 103 further comprising an optical coating or heat reflective coating disposed on the baffle or on one of the face portions of the block.

111. The construction block as in claim 103 further comprising at least one opening located on the baffle.

112. A construction block comprising:

a body formed from a resinous material, the body formed by a pair of face portions with inwardly directed side portions, edge portions of the side portions in abutting relationship and joined by a welded or adhesive seam defining an interior chamber; and a baffle having an outer periphery, the baffle completely located within the interior chamber and joined to the body along the seam such that the outer periphery is attached to an inner surface of only one of the side portions such that opposing attachment points on the inner surface of the one side portion face one another, the baffle disposed generally parallel with the pair of face portions, to form two separate areas within the interior chamber such that air flow between the two separate areas is minimized and whereby a bellow effect of the faces is reduced.

113. The construction block as in claim 112 wherein the outer periphery of the baffle has a upwardly turned up edge.

114. The construction block as in claim 113 wherein the body has a recessed section for receiving the turned up edge.

115. The construction block as in claim 112 further comprising a desiccant disposed within the interior chamber.

116. The construction block as in claim 112 further comprising an insulation gas disposed within the interior chamber.

117. The construction block as in claim 116 wherein the insulation gas is selected from the group consisting of argon, krypton, xenon or combinations thereof.

118. The construction block as in claim 112 further comprising at least one opening located on the construction block.

119. The construction block as in claim 112 further comprising an optical coating or heat reflective coating disposed on the baffle or on one of the face portions of the block.

120. The construction block as in claim 112 further comprising at least one opening located on the baffle.

121. A construction block comprising:

a body formed from a resinous material, the body formed by a pair of face portions with inwardly directed flat side portions, edge portions of the side portions in abutting relationship and joined by a welded or adhesive seam defining an interior chamber; and a baffle having an outer periphery, the baffle completely located within the interior chamber and disposed generally parallel with the pair of face portions such that the outer periphery is attached to an inner surface of only one of the side portions such that opposing attachment points on the inner surface of the one side portion face one another, to form two separate areas within the interior chamber such that air flow between the two separate areas is minimized and whereby a bellow effect of the faces is reduced.

122. The construction block as in claim 121 wherein the outer periphery of the baffle has a upwardly turned up edge.

123. The construction block as in claim 122 wherein the body has a recessed section for receiving the turned up edge.

124. The construction block as in claim 121 further comprising a desiccant disposed within the interior chamber.

125. The construction block as in claim 121 further comprising an insulation gas disposed within the interior chamber.

126. The construction block as in claim 125 wherein the insulation gas is selected from the group consisting of argon, krypton, xenon or combinations thereof.

127. The construction block as in claim 121 further comprising at least one opening located on the construction block.

128. The construction block as in claim 121 further comprising an optical coating or heat reflective coating disposed on the baffle or on one of the face portions of the block.

129. The construction block as in claim 121 further comprising at least one opening located on the baffle.

* * * * *